US010334958B2

(12) United States Patent
Wyler

(10) Patent No.: US 10,334,958 B2
(45) Date of Patent: Jul. 2, 2019

(54) GLUELESS POCKETED SPRING ASSEMBLY WITH IMPROVED AIRFLOW

(71) Applicant: L&P Property Management Company, South Gate, CA (US)

(72) Inventor: Marcel Wyler, Tubach (CH)

(73) Assignee: L&P Property Management Company, South Gate, CA (US)

( * ) Notice: Subject to any disclaimer, the term of this patent is extended or adjusted under 35 U.S.C. 154(b) by 263 days.

(21) Appl. No.: 15/590,524

(22) Filed: May 9, 2017

(65) Prior Publication Data

US 2018/0325276 A1 Nov. 15, 2018

(51) Int. Cl.

| | |
|---|---|
| ***A47C 27/06*** | (2006.01) |
| ***A47C 27/07*** | (2006.01) |
| ***A47C 27/05*** | (2006.01) |

(52) U.S. Cl.

CPC ..... *A47C 27/064* (2013.01); *A47C 27/056* (2013.01); *A47C 27/062* (2013.01); *A47C 27/066* (2013.01); *A47C 27/07* (2013.01); *A47C 27/063* (2013.01)

(58) Field of Classification Search

CPC ..... A47C 27/06; A47C 27/063; A47C 27/064; A47C 27/07; A47C 27/05; A47C 27/056; A47C 27/04

USPC ..... 5/720, 716, 655.7, 655.8

See application file for complete search history.

(56) References Cited

U.S. PATENT DOCUMENTS

| | | | | | |
|---|---|---|---|---|---|
| 3,462,779 | A * | 8/1969 | Thompson | A47C 27/063 | 297/452.53 |
| 4,485,506 | A * | 12/1984 | Stumpf | A47C 27/064 | 267/83 |
| 4,523,344 | A * | 6/1985 | Stumpf | A47C 27/064 | 5/655.8 |
| 5,669,093 | A * | 9/1997 | Ogle | B68G 9/00 | 5/655.8 |
| 5,761,784 | A * | 6/1998 | Ogle | B68G 9/00 | 5/420 |
| 5,957,438 | A * | 9/1999 | Workman | A47C 27/063 | 267/90 |
| 6,036,181 | A * | 3/2000 | Workman | A47C 27/063 | 112/475.08 |
| 6,085,397 | A * | 7/2000 | Workman | A47C 27/063 | 267/90 |

(Continued)

FOREIGN PATENT DOCUMENTS

| | | |
|---|---|---|
| CN | 204273903 | 4/2015 |
| DE | 112014002759 | 3/2016 |
| JP | 2015213657 | 12/2015 |

*Primary Examiner* — Robert G Santos

(74) *Attorney, Agent, or Firm* — Wood, Herron & Evans, LLP

(57) ABSTRACT

A pocketed spring assembly comprises first and second sheets of fabric and a plurality of parallel rows of springs held in place with the sheets. Longitudinal seams joining the first and second sheets extend generally the same direction as the rows of springs. Pockets are formed along a strand of springs by aligned separating seams. At least one spring is positioned in each pocket. Each separating seam joins one of the sheets to itself and keeps the spring in its pocket. Ends of aligned separating seams are spaced from each other, thereby improving airflow between pockets. Openings between adjacent longitudinal seams further improve airflow.

23 Claims, 13 Drawing Sheets

(56) References Cited

U.S. PATENT DOCUMENTS

| | | | | |
|---|---|---|---|---|
| 6,098,968 | A * | 8/2000 | Workman | A47C 27/063 267/90 |
| 7,877,964 | B2 * | 2/2011 | Spinks | B68G 9/00 53/438 |
| 9,943,173 | B2 * | 4/2018 | Krtek | A47C 27/064 |
| 9,968,203 | B2 * | 5/2018 | Mossbeck | A47C 27/064 |
| 10,167,186 | B2 * | 1/2019 | Spinks | B68G 9/00 |
| 2009/0266032 | A1 * | 10/2009 | Spinks | B68G 9/00 53/438 |
| 2013/0247518 | A1 * | 9/2013 | Spinks | B68G 9/00 53/438 |
| 2016/0220033 | A1 | 8/2016 | Mossbeck et al. | |
| 2016/0235212 | A1 * | 8/2016 | Krtek | A47C 27/064 |
| 2016/0235213 | A1 | 8/2016 | Long | |
| 2017/0086597 | A1 * | 3/2017 | Dahlin | A47C 23/0435 |
| 2018/0072559 | A9 * | 3/2018 | Spinks | B68G 9/00 |
| 2018/0325276 | A1 * | 11/2018 | Wyler | A47C 27/064 |

* cited by examiner

GLUELESS POCKETED SPRING ASSEMBLY WITH IMPROVED AIRFLOW

FIELD OF THE INVENTION

This invention relates generally to bedding and seating products and, more particularly, to pocketed spring assemblies used in bedding and seating products.

BACKGROUND OF THE INVENTION

Mattress spring core construction over the years has been a continuously improving art with advancements in materials and machine technology. A well-known form of spring core construction is known as a Marshall spring construction wherein metal coil springs are encapsulated in individual pockets of fabric and formed as elongate or continuous strings of pocketed coil springs. In an earlier form, these strings of coil springs were manufactured by folding an elongate piece of fabric in half lengthwise to form two plies of fabric and stitching transverse and longitudinal seams to join the plies of fabric to define pockets within which the springs were enveloped.

More recently, improvements in spring core constructions have involved the use of fabrics which are thermally or ultrasonically weldable to themselves. By using such welding techniques, these fabrics have been advantageously used to create strings of individually pocketed coil springs wherein transverse and longitudinal welds, instead of stitching, are used to form the pockets encapsulating the springs. One such fabric is a non-woven polypropylene fabric.

One of the long recognized advantages of bedding or seating products incorporating springs when compared to bedding or seating products made of foam is the coolness or lower temperature of the product. In other words, when a user sleeps on a mattress made with coil springs, the sleep surface is cooler than the sleep surface of a mattress made with foam. However, a mattress made with pocketed coil springs may be warmer than a mattress made with conventional springs.

Once strings of pocketed springs are constructed, adjacent strings are typically glued together to form a pocketed spring assembly of the desired size for a mattress, cushion or the like. For example, multiple strings may be arranged in a row pattern corresponding to the desired size and shape of a mattress or the like, and adjacent strings of strings glued together. The result is a unitary assembly of pocketed coil springs serving as a complete spring core assembly. However, the weak point in the pocketed spring assembly is along the glue lines.

Therefore, there remains a need for a pocketed spring assembly which incorporates multiple rows of springs without using glue, thereby providing a stronger pocketing spring assembly.

There is also a need for a pocketed spring assembly for use in a bedding or seating product having improved or increased airflow through the pocketed spring assembly to cool the pocketed spring assembly.

SUMMARY OF THE INVENTION

In one aspect, a bedding or seating product comprising a pocketed spring assembly is provided. The pocketed spring assembly comprises first and second sheets of fabric and rows of springs arranged between the first and second sheets of fabric. The first and second sheets of fabric are joined by longitudinal seams to separate adjacent rows of springs and create strands of springs. Each strand comprises a row of springs. In some embodiments, at least two longitudinal seams separate each row of springs along a strand from an adjacent row of springs along a strand. In other embodiments, one longitudinal seam separates adjacent strands of pocketed springs.

Pockets are formed along each strand of springs by separating seams. Each of the separating seams joins either the first sheet of fabric to itself or the second sheet of fabric to itself. At least one spring is positioned in each of the pockets. One of the separating seams extends downwardly from an upper surface of the strand and an aligned separating seam extends upwards from a lower surface of the strand. Each of the separating seams is approximately one third of the height of the pocketed springs; less than half the height of the pocketed springs. Aligned separating seams of such length provide a gap between ends of the aligned separating seams. Upon assembly, these gaps increase in width, thereby improving air flow between adjacent pockets. The air may flow freely through the gaps between adjacent pockets. The springs may be coil springs or any other known resilient members. Each of the pocketed springs may have the same height or the pocketed springs may be different heights.

Cushioning materials may be placed over one or both sides of the pocketed spring assembly. Any known covering may encase the pocketed spring assembly and cushioning materials.

The strands of springs extend generally in the same direction as the longitudinal seams. This direction may extend longitudinally which, in a bedding product such as a mattress, is from head-to-foot. Alternatively, the strands of springs and longitudinal seams of the pocketed spring assembly may extend transversely or from side-to-side in a bedding product.

A bedding product incorporating a pocketed spring assembly in accordance with the present invention may be single-sided or double-sided. A bedding or seating product in accordance with the present invention may be posturized into regions or zones of different firmness by incorporating different springs into the pockets of one of the pocketed spring assemblies or by changing the number of longitudinal seams between adjacent strands of pocketed springs.

In another aspect, a pocketed spring assembly for a bedding or seating product is provided. The pocketed spring assembly comprises a first layer of fabric and a second layer of fabric. The pocketed spring assembly further comprises an array of springs comprising rows of springs between the first and second layers of fabric. The first and second layers of fabric are joined by at least one longitudinal seam separating adjacent rows of springs. Each row of springs is considered a strand of springs. Pockets are formed along each strand by first and second separating seams. Each of the first separating seams joins the first layer of fabric to itself. Each of the second separating seams joins the second layer of fabric to itself. At least one spring, such as a coil spring, for example, is positioned in each of the pockets. Each of the first separating seams is spaced from a corresponding second separating seam to partially separate adjacent pockets, thereby allowing air to flow through gaps between adjacent pockets.

In the embodiments in which multiple longitudinal seams separate adjacent strands, air further cools the pocketed spring assembly by flowing through openings between adjacent longitudinal seams between adjacent strands. Each of these openings extends through the first and second layers or sheets of fabric and allows air to flow through the interior of the pocketed spring assembly to further cool the pocketed spring assembly.

In another aspect, a pocketed spring assembly for a bedding or seating product is provided. The pocketed spring assembly comprises first and second sheets of fabric. The pocketed spring assembly further comprises rows of springs between the first and second sheets of fabric. Each of the rows of springs is separated from at least one adjacent row of springs by longitudinal seams joining the first and second sheets of fabric. Pockets are formed along a strand of springs by first and second separating seams. Each of the first separating seams joins the first sheet of fabric to itself. Each of the second separating seams joins the second sheet of fabric to itself. At least one spring is positioned in each of the pockets. Each of the first separating seams is aligned with and spaced from a corresponding second separating seam to partially open each of the pockets, thereby allowing air to flow between adjacent pockets. Although the springs are usually conventional metal springs, such as coil springs, the springs may be any resilient elements, such as pieces of foam, for example.

The accompanying drawings, which are incorporated in and constitute a part of this specification, illustrate embodiments of the invention and, together with the summary of the invention given above, and the detailed description of the drawings given below, explain the principles of the present invention.

BRIEF DESCRIPTION OF THE DRAWINGS

FIG. 3AA is a cross-sectional view of a portion of another pocketed spring assembly being assembled.

FIG. 3BB is a cross-sectional view of the pocketed spring assembly of FIG. 3AA fully assembled.

DETAILED DESCRIPTION OF THE INVENTION

Figure 1:
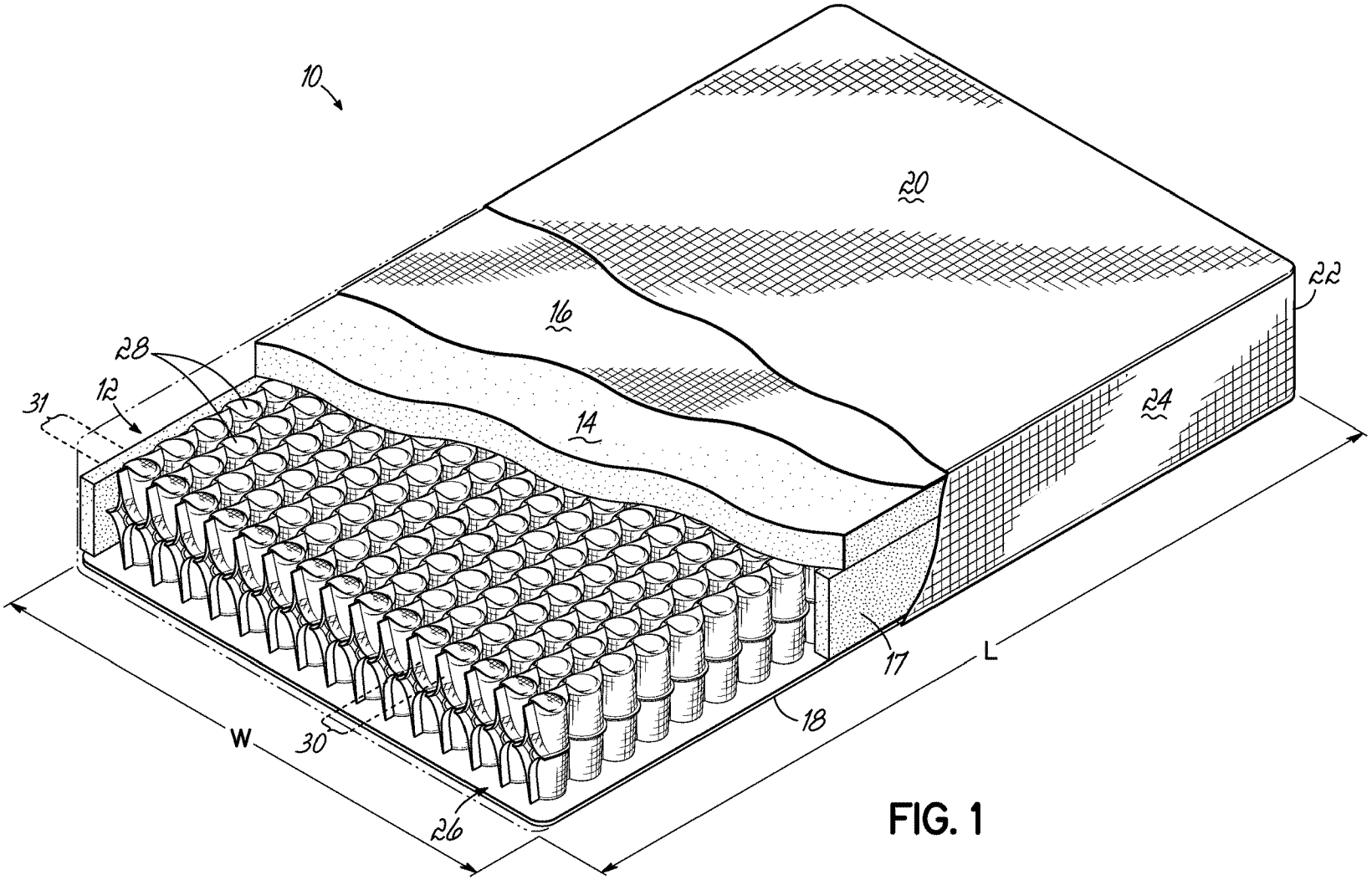
FIG. 1 is a perspective view, partially broken away, of a single-sided bedding or seating product incorporating one embodiment of pocketed spring assembly according to the principles of the present invention.

Referring to FIG. 1, there is illustrated a bedding product in the form of a single-sided mattress 10 incorporating one of the pocketed spring assemblies 12 of the present invention. Bedding product or mattress 10 comprises conventional padding or cushioning layers 14, 16, which may be foam, fiber, gel, a pocketed spring blanket or any other suitable materials or any combination thereof, laying over pocketed spring assembly 12. The pocketed spring assembly 12 is surrounded with a border 17 made of foam or any other suitable material (only a portion being shown in FIG. 1). Although one type of border 17 is illustrated, the border may assume other forms or shapes of any desired size, such as pocketed coil springs. Alternatively, border 17 or any border may be omitted in any embodiment described or shown herein. This complete assembly is mounted upon a base 18 and is completely enclosed within an upholstered covering material 20. The base 18 and border 17 are known in the industry as a "bucket" into which a pocketed spring assembly 12 is inserted before the "bucket" is covered with one or more padding or cushioning layers.

As shown in FIG. 1, fully assembled, bedding product 10 has a length "L" defined as the linear distance between opposed end surfaces 22 (only one being shown in FIG. 1). Similarly, the assembled product 10 has a width "W" defined as the linear distance between opposed side surfaces 24 (only one being shown in FIG. 1). In the product shown in FIG. 1, the length is illustrated as being greater than the width. However, it is within the scope of the present invention that the length and width may be identical, as in a square product.

As shown in FIG. 1, pocketed spring assembly 12 is manufactured from multiple strands 26 of pocketed springs 28. Each strand 26 extends longitudinally or from head-to-foot along the full length of the pocketed spring assembly 12 of product 10.

Figure 1A:
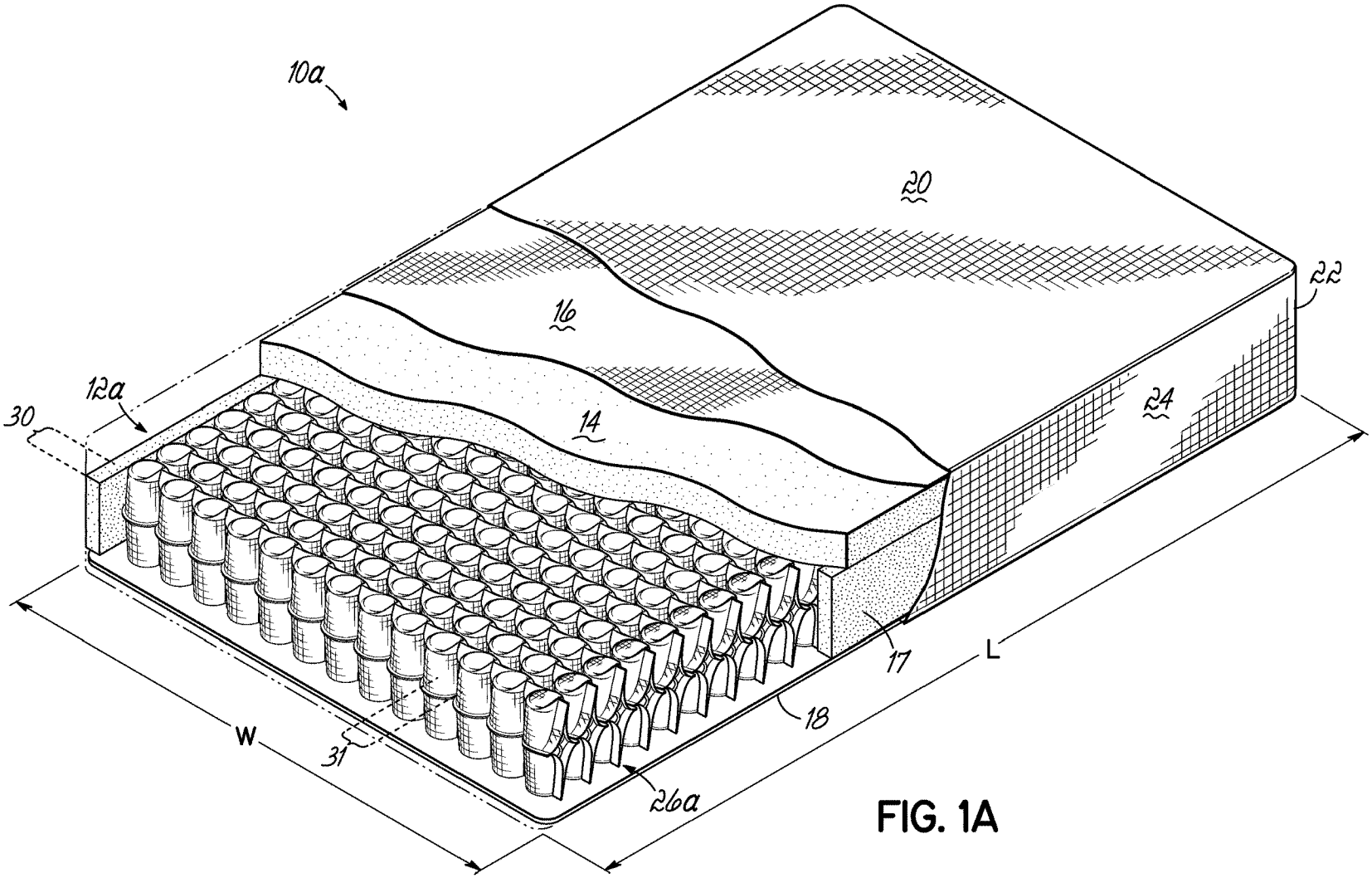
FIG. 1A is a perspective view, partially broken away, of a single-sided bedding or seating product incorporating another pocketed spring assembly.

Although the strands 26 extend longitudinally or from head-to-foot in the pocketed spring assembly 12 of FIG. 1, strands 26*a* may extend transversely or from side-to-side as shown in the pocketed spring assembly 12*a* shown in the product 10*a* shown in FIG. 1A. Pocketed spring assembly 12*a* comprises multiple strands 26*a* of pocketed springs, identical to the strands of springs 26, but shorter in length.

Figure 1B:
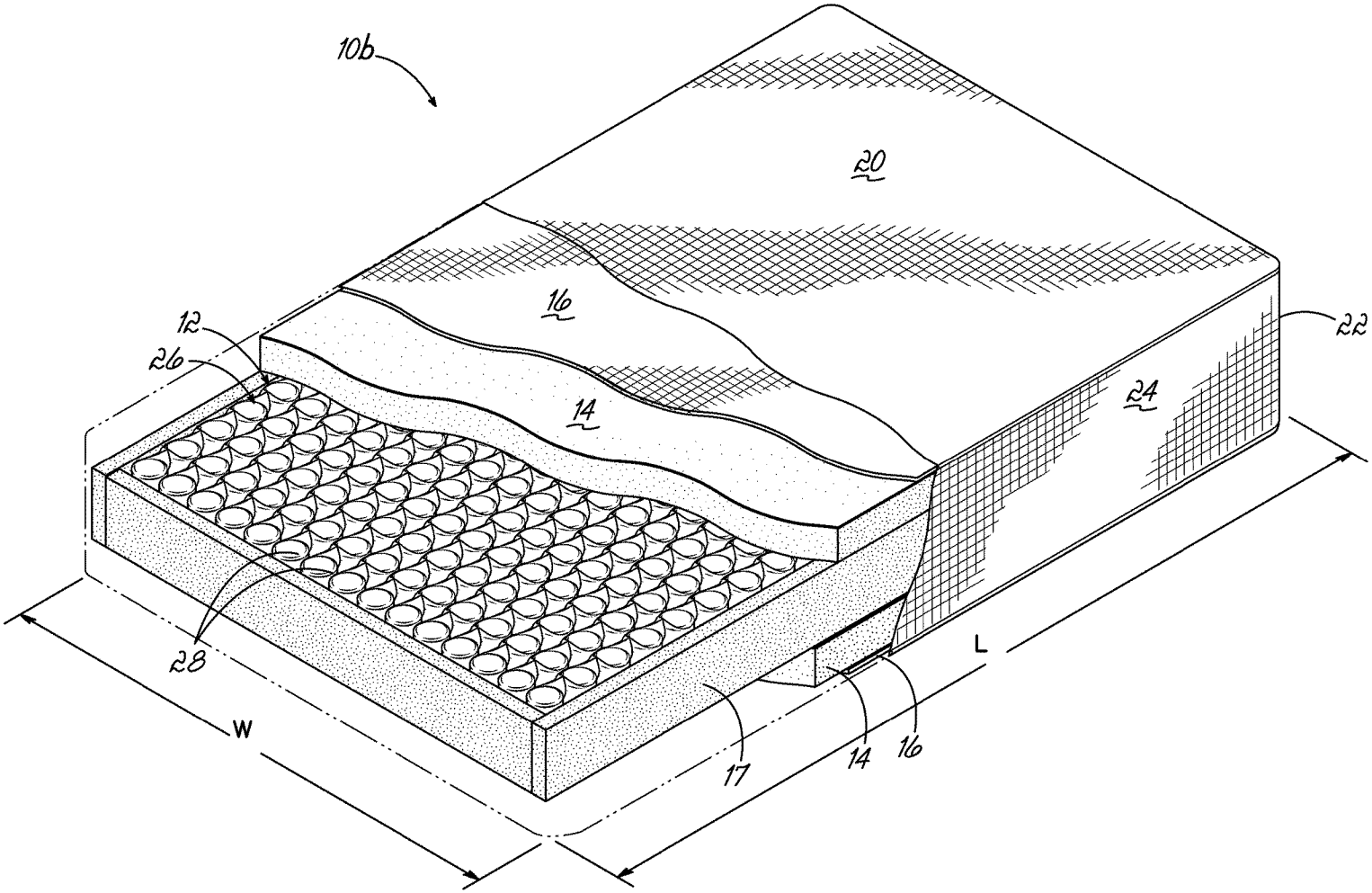
FIG. 1B is a perspective view, partially broken away, of a double-sided bedding product incorporating another pocketed spring assembly.

FIG. 1B illustrates a double-sided mattress 10*b* comprising a pocketed spring assembly 12 and border 17 identical to those shown in the mattress 10 of FIG. 1. However, the mattress 10*b* of FIG. 1B has conventional padding layers 14, 16 above and below pocketed spring assembly 12. The pocketed spring assembly 12 comprises the same pocketed springs 28 as those shown in FIGS. 1, 1B and 1C.

Figure 1C:
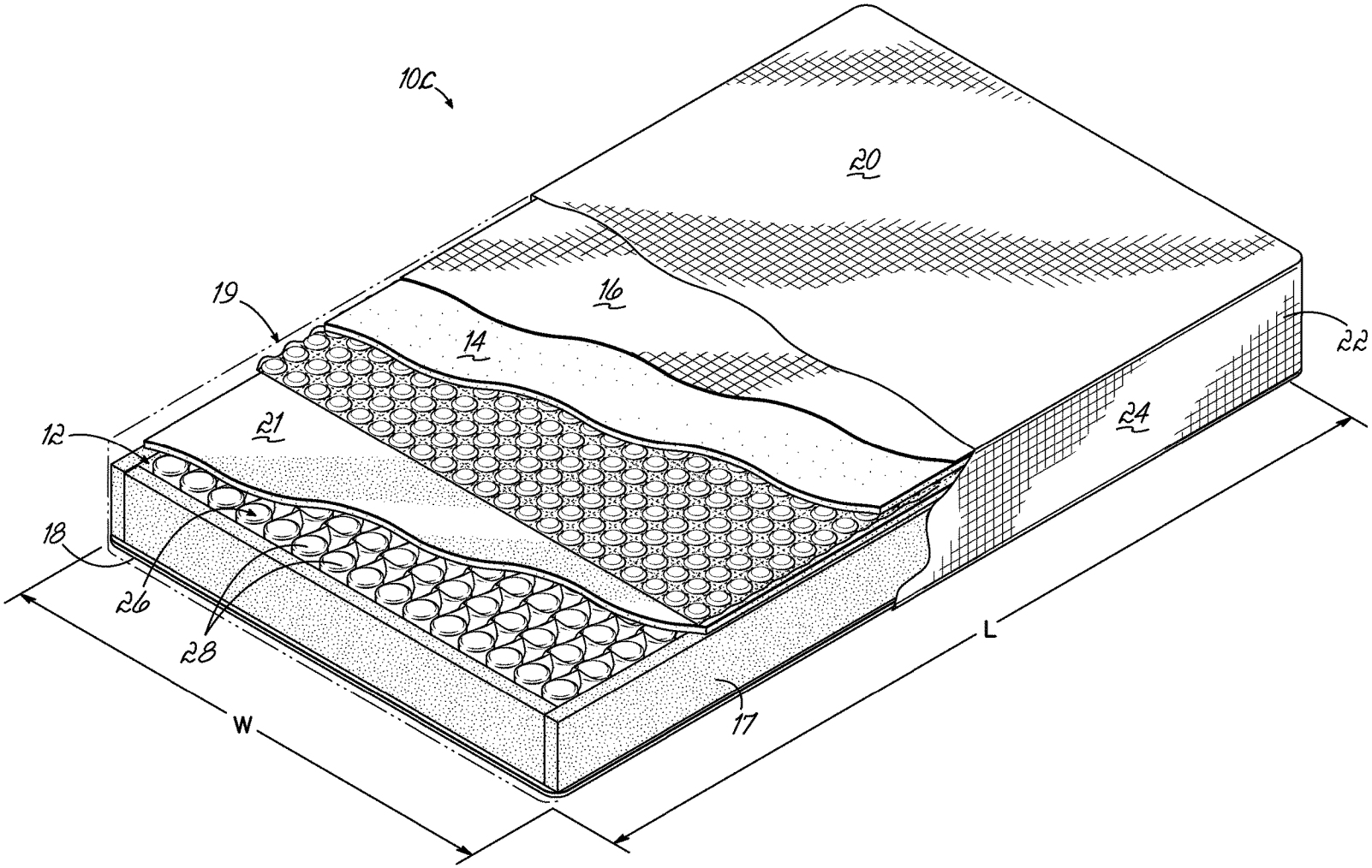
FIG. 1C is a perspective view, partially broken away, of another single-sided bedding product incorporating the pocketed spring assembly of FIG. 1.

FIG. 1C illustrates a single-sided mattress 10*c* comprising a pocketed spring assembly 12 and border 17 identical to those shown in the mattress 10 of FIG. 1. However, the mattress 10*c* of FIG. 1C has a pocketed topper 19 employing miniature or small pocketed coil springs in addition to padding layers 14, 16 above the pocketed topper 19. A scrim layer 21 separates the pocketed topper 19 from the pocketed spring assembly 12. Although one configuration of pocketed topper 19 is illustrated, any known pocketed topper may be used.

Figure 1D:
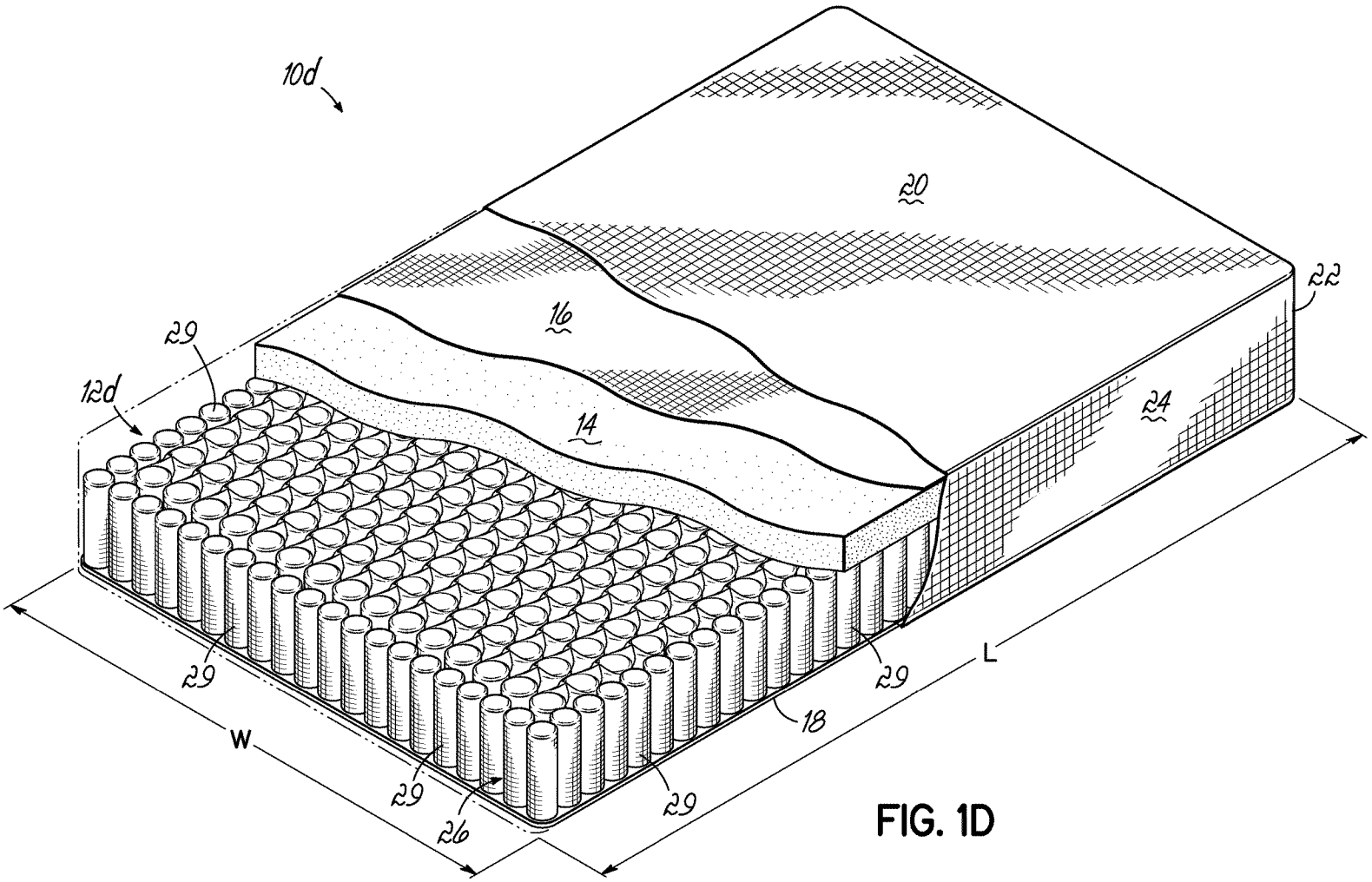
FIG. 1D is a perspective view, partially broken away, of another single-sided bedding product incorporating the pocketed spring assembly of FIG. 1.

FIG. 1D illustrates a single-sided mattress 10*d* comprising pocketed spring assembly 12*d*. In place of a foam border 17, a border comprising one layer of pocketed coil springs 29 surrounds the perimeter of an interior portion of pocketed spring assembly 12*d* and functions as edge support. Although a single perimeter layer of pocketed coil springs 29 is illustrated in FIG. 1D as a portion of pocketed spring assembly 12*d*, additional layers of edge support pocketed coil springs 29 may be incorporated into any of the pocketed spring assemblies shown or described herein.

Although FIG. 1D shows perimeter pocketed coil springs 29 being the same height as the interior portion of pocketed spring assembly 12*d*, the pocketed coil springs 29 functioning as edge support may be shorter or taller than the height of the pocketed springs of an interior portion of pocketed spring assembly they surround. In some applications, rather than surrounding all four sides of a pocketed spring assembly portion, pocketed coil springs 29 functioning as edge support may only extend along two opposed sides of the pocketed spring assembly.

In accordance with this invention, any of the padding or cushioning layers, including the pocketed topper 19, may be omitted in any of the products shown or described herein. The novel features reside in the pocketed spring assembly.

These strands of pocketed springs 26 and 26*a*, and any other strands of springs described or shown herein, may be connected in side-by-side relationship without the use of glue, thereby improving the strength of the pocketed spring assembly. Adjacent strands are integrally formed using multiple sheets of fabric to create an assembly or matrix of springs having multiple rows of pocketed springs. Unlike known prior art pocketed spring assemblies, each strand is not formed using a single piece of fabric.

Figure 2:
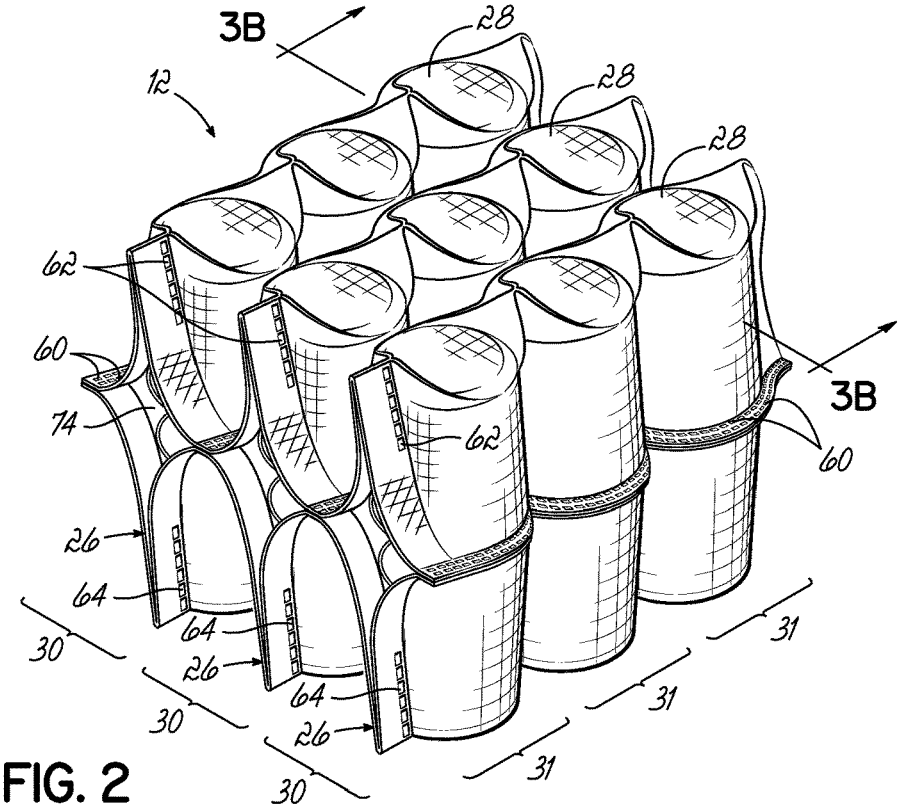
FIG. 2 is a perspective view of a portion of the pocketed spring assembly of FIG. 1 in a relaxed condition.

Referring to FIG. 2, the strands 26 of pocketed springs may be joined so that the individually pocketed springs 28 are aligned in rows 30 and columns 31 in pocketed spring assembly 12. As shown in the drawings, rows 30 extend in the same direction as the strands 26.

Figure 2A:
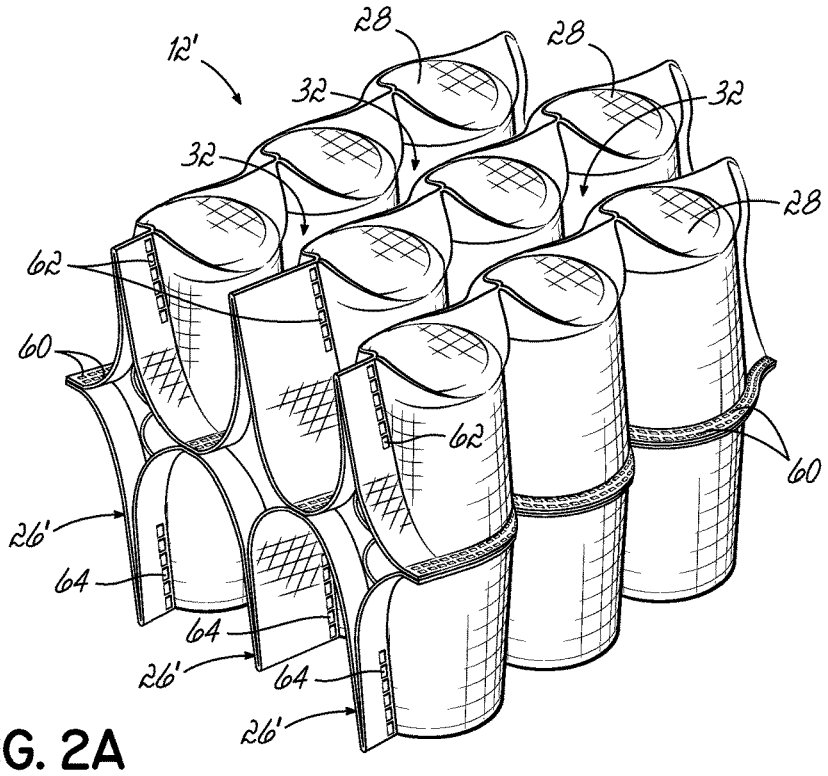
FIG. 2A is a perspective view of a portion of another pocketed spring assembly in accordance with the present invention, the rows of springs being offset from one another.

Alternatively, as shown in FIG. 2A, strands 26' of pocketed springs 28 may be offset from one another in a pocketed spring assembly. In such an arrangement, shown in FIG. 2A, the individually pocketed springs are not aligned in rows and columns; instead the individually pocketed springs fill gaps or voids 32 of the adjacent rows 26' of pocketed springs. FIG. 2A shows a portion of a pocketed spring assembly 12' with multiple strands 26' arranged in this manner. This alignment of strands of springs may be incorporated into any of the pocketed spring assemblies illustrated or described herein.

Figure 3A:
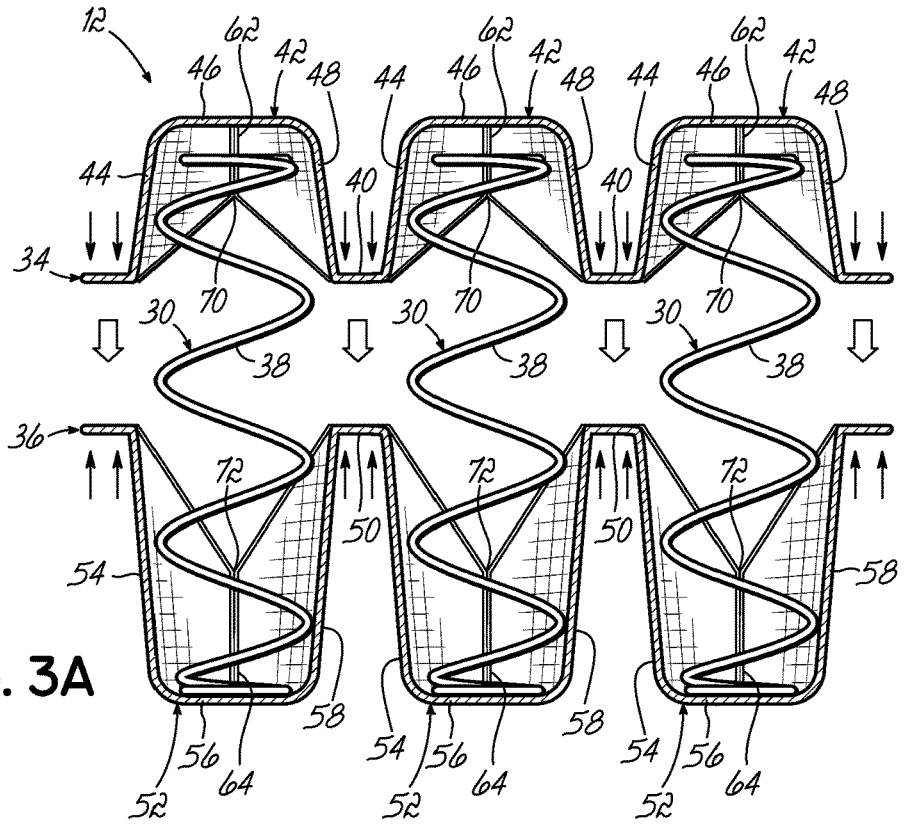
FIG. 3A is a cross-sectional view of a portion of a pocketed spring assembly being assembled.

As best illustrated in FIG. 3A, pocketed spring assembly 12 comprises a first or upper sheet of fabric 34 and a second or lower sheet of fabric 36. The fabric may be polypropylene fabric, which may be welded to itself. Alternatively, the fabric may not be weldable, in which case the seams joining the first and second sheets of fabric and the separating seams defining pockets within a strand, would be sewn seams, as opposed to weld seams.

FIG. 3A illustrates a side elevational view of three rows 30 of aligned coil springs 38 being made into three strands 26 of pocketed spring assembly 12. The first sheet of fabric 34 is passed over an upper portion of a row 30 of coil springs 38 so the first sheet of fabric 34 has an inverted cup shape over each row 30 of coil springs 38. As shown in FIG. 3A, the first sheet of fabric 34 has generally planar portions 40 between the inverted cup-shaped portions 42. Each inverted cup shaped portion 42 comprises a rising portion 44 extending in a positively sloped direction, a generally planar top portion 46 and dropping portion 48 extending in a negatively sloped direction.

The second sheet of fabric 36 is passed under a lower portion of a row 30 of coil springs 38 so the second sheet of fabric 36 has a cup shape over each row 30 of coil springs 38. As shown in FIG. 3A, the second sheet of fabric 36 has generally planar portions 50 between cup-shaped portions 52. Each cup-shaped portion 52 comprises a dropping portion 54 extending in a negatively sloped direction, a generally planar bottom portion 56, and rising portion 58 extending in a positively sloped direction. In FIG. 3A, each of the rows 30 of coil springs 38 is illustrated extending into the page.

Figure 3B:
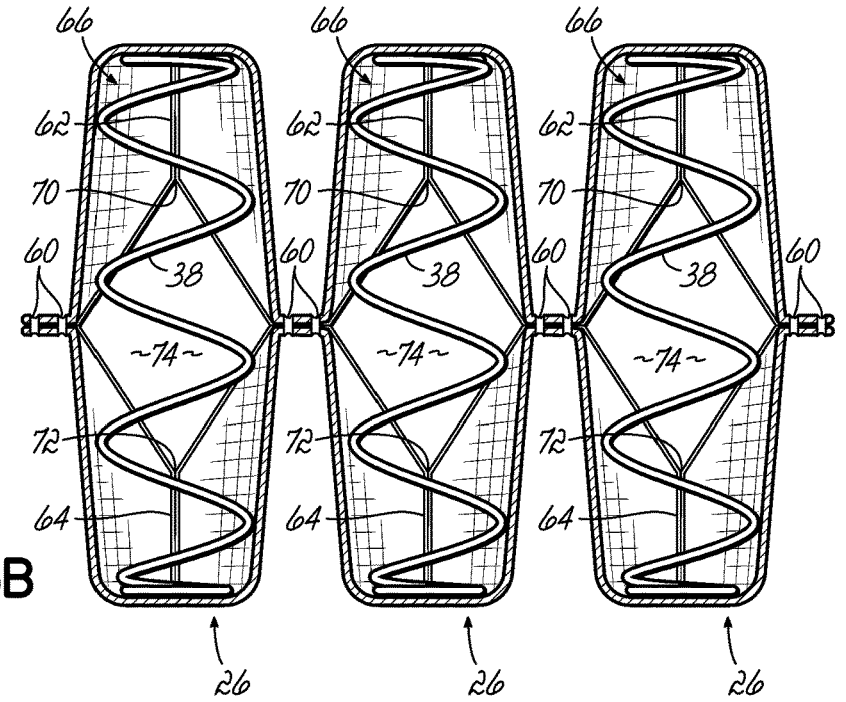
FIG. 3B is a cross-sectional view of the pocketed spring assembly of FIG. 3A fully assembled.
Figure 3A:
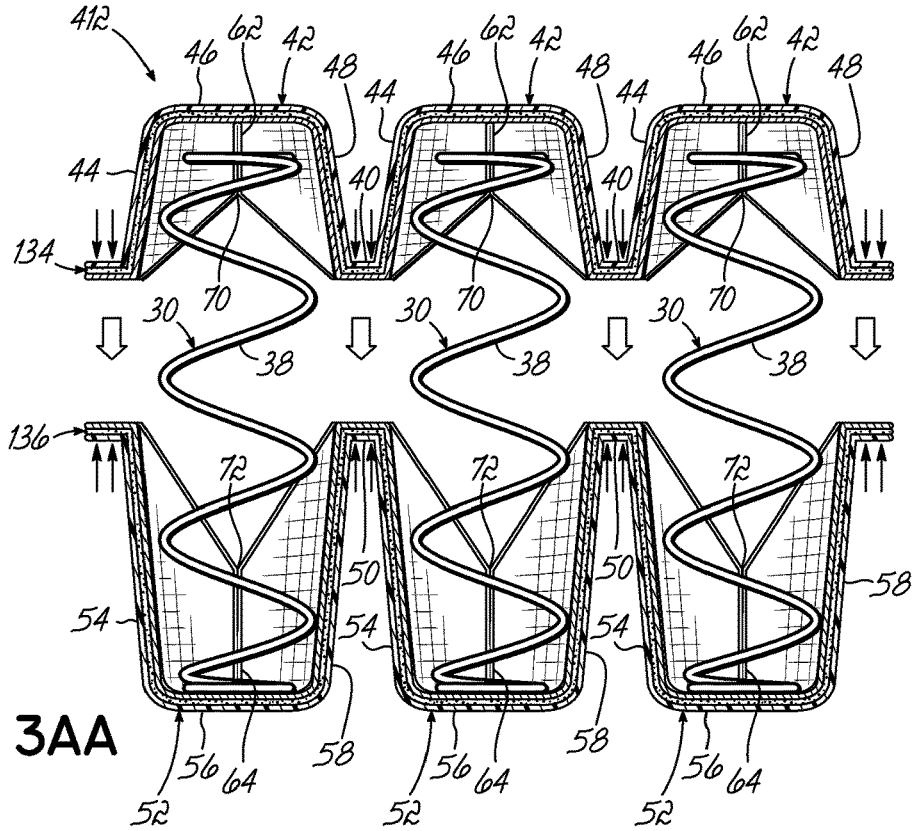
Figure 3B:
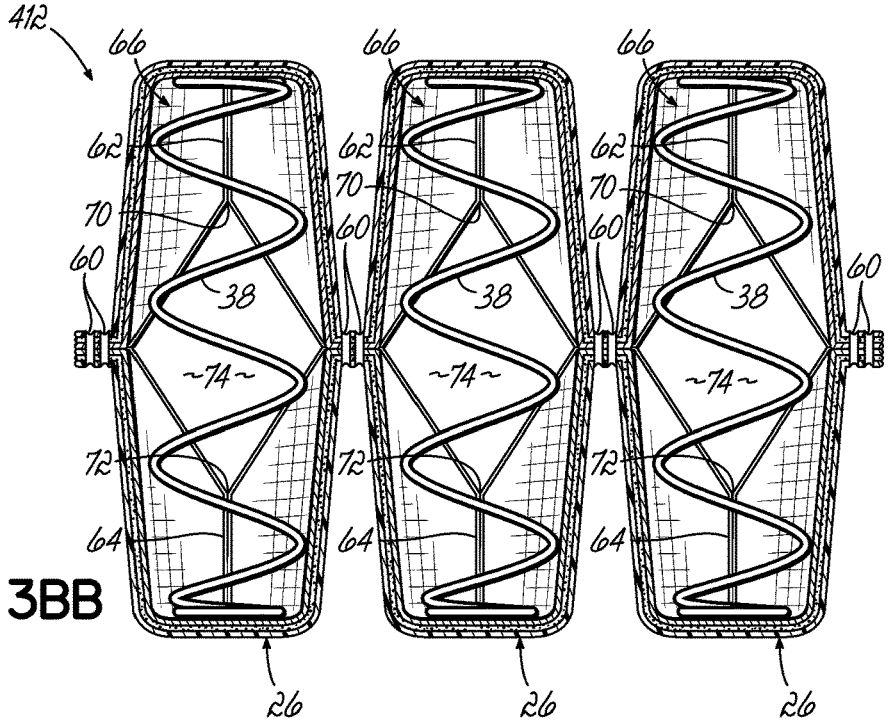

As shown in FIG. 3B, the first and second sheets of fabric 34, 36 are joined by longitudinal seams 60. Two spaced longitudinal seams 60 are located between each row 30 of pocketed springs 38. The longitudinal seams 60 join the generally planar portions 40 of the first sheet of fabric 34 to the generally planar portions 50 of the second sheet of fabric 36 to create strands 26 of pocketed springs 38. In FIG. 3B, each of the strands 26 is illustrated extending into the page.

As best shown in FIGS. 2 and 3B, each strand 26 comprises a row 30 of individually pocketed coil springs 38. Each strand 26 comprises a plurality of interconnected fabric pockets 66, separated by first and second separating seams 62, 64, respectively. Aligned first and second separating seams 62, 64 separate adjacent pockets 66 and adjacent coil springs 38 therein from each other. At each end of each row or strand 26 of coil springs 38, one first separating seam 62 and an aligned second separating seam 64 keep the outermost coil springs 38 in the strand 26.

Figure 5:
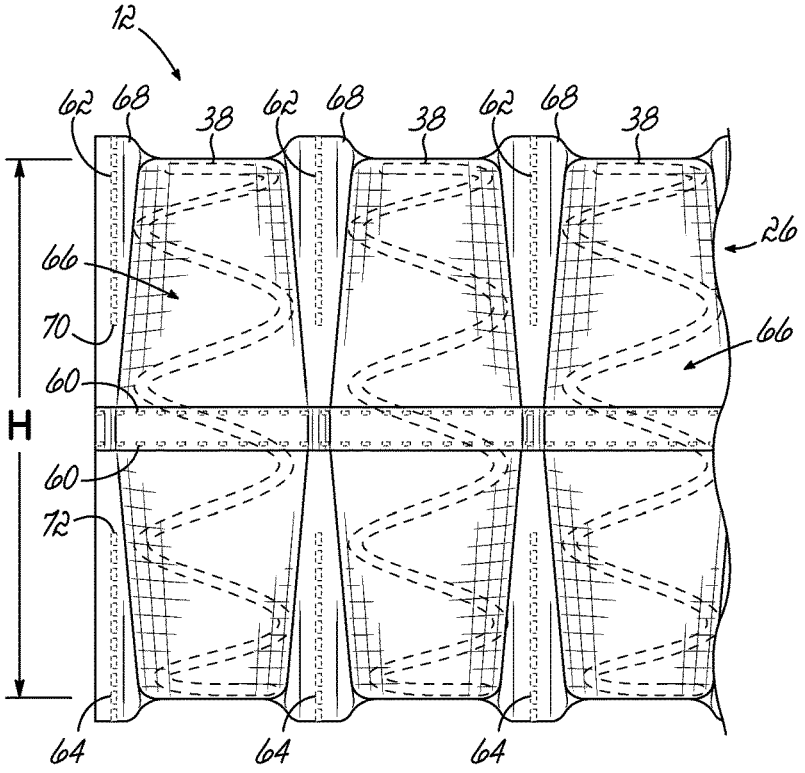
FIG. 5 is a side elevational view of the portion of the pocketed spring assembly of FIG. 4 in a relaxed condition.

As best shown in FIG. 5, each first separating seam 62 joins the first sheet of fabric 34 to itself and extends downwardly from an ear 68 between adjacent pockets 66 to an end 70. Each second separating seam 64 joins the second sheet of fabric 36 to itself and extends upwardly from an ear 68 between adjacent pockets 66 to an end 72. Ears 68 are known to those skilled in the art.

As shown in FIG. 5, each first separating seam 62 has a length approximately one-third the height "H" of the pocketed coil spring 38 and pockets 66. As best shown in FIGS. 2 and 3B, the distance between the ends 70, 72 of aligned first and second separating seams 62, 64 defines a gap 74. When fully assembled, the gaps 74 assume a diamond-shaped configuration, as shown in FIGS. 2 and 3B, which allow air to flow through the pockets 66 and through the strands 26 of pocketed springs 38, thereby cooling any of the pocketed spring assemblies shown or described herein. This is true for any of the strands shown or described herein, including strands 26*a* and 26'.

Each of the fabric pockets 62 contains at least one coil spring 38. The coil spring 38 is preferably made of one piece of wire of a uniform diameter, but may be made of other materials, multiple strands of twisted wire and/or may be a non-uniform diameter. Although the drawings show one version of coil spring 38, any known coil springs may be used in accordance with the present invention. The coil springs 38 are preferably six to eight inches tall. In one embodiment, each of the coil springs 38 of each of the rows 30 of each of the strands is the same height. However, the coil springs 38 of some of the rows 30 of some of the strands may be a different height than other coil springs 38 of other rows 30 of other strands.

Figure 4:
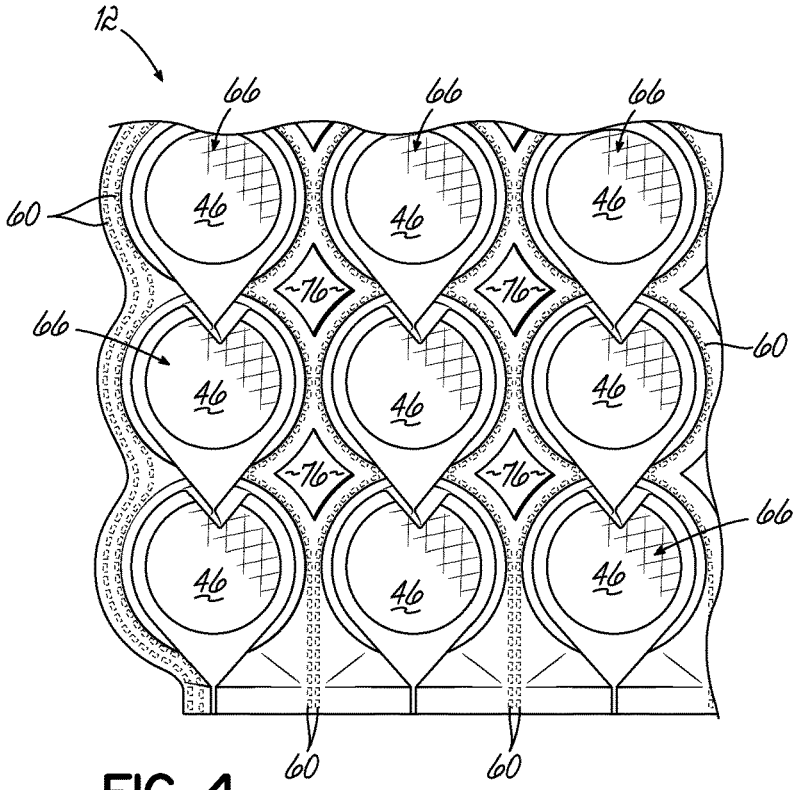
FIG. 4 is a top view of a portion of the pocketed spring assembly of FIG. 1 in a relaxed condition.

As shown in FIG. 4, between adjacent spaced longitudinal seams 60 between adjacent strands 26, during the manufacturing process, an interstitial slit is made through the first and second sheets of fabric 34, 36 between fabric pockets 66. When the pocketed spring assembly 12 expands, each interstitial slit becomes a diamond-shaped opening 76. Furthermore, each of the longitudinal seams 60 between adjacent strands 26 assumes a non-linear pattern as shown in FIG. 4. Each of the longitudinal seams 60 has curved portions extending along the sides of the pockets 66. The slits made during the manufacturing process, which become diamond-shaped openings 76, enable each of the longitudinal seams 60 to conform to the shapes of the full pockets 66 along the lengths of the longitudinal seams 60. The slits (not shown) allow the fabric to wrap around the springs 38 in an aesthetically pleasing manner. The pocketed spring assembly, with the openings 76 between adjacent longitudinal seams 60, improves the appearance of the pocketed spring assembly.

Although the seams or welds in the embodiments shown herein are shown as being heat-welded spaced rectangles, any of the seams may be spaced dots, triangles or solid line segments without spaces.

Figure 6:
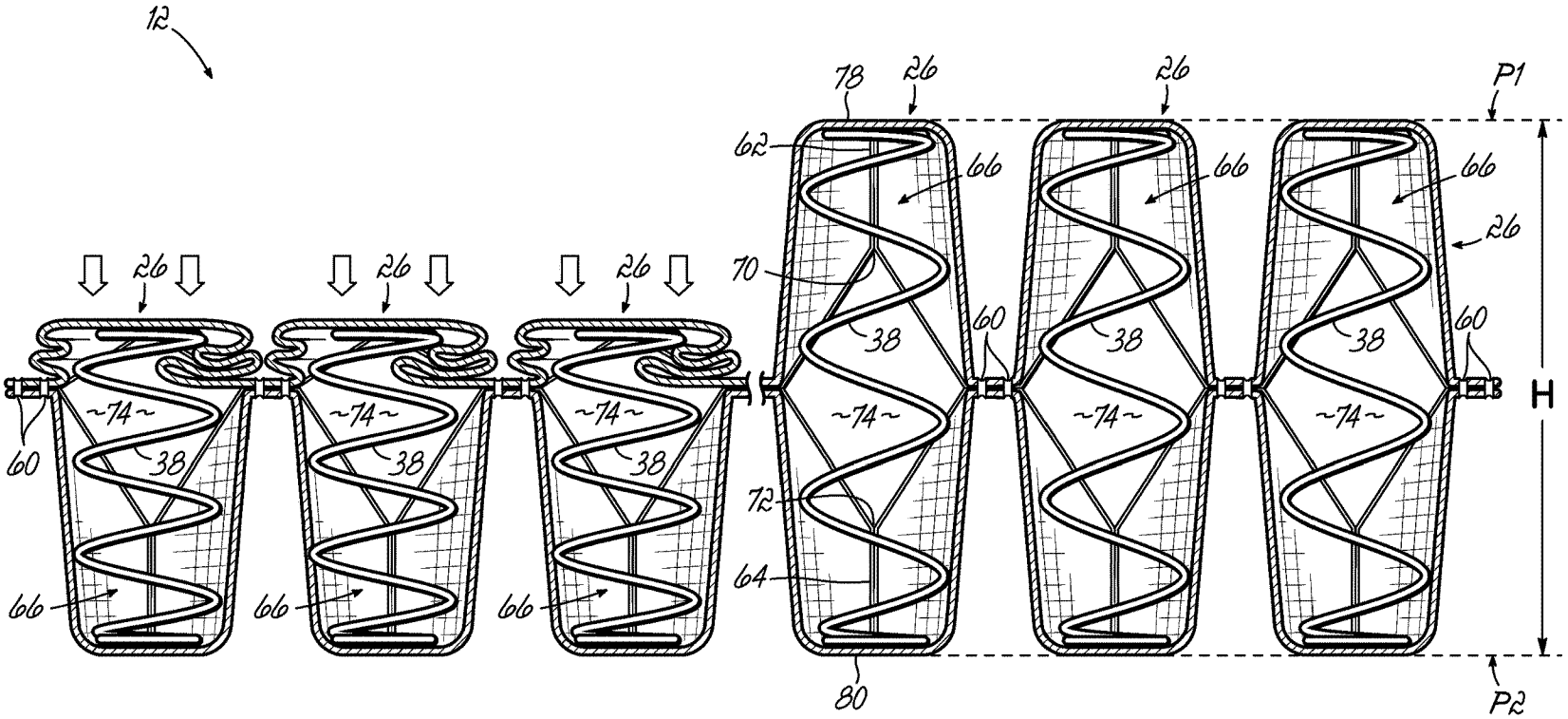
FIG. 6 is a cross-sectional view of a portion of the pocketed spring assembly of FIG. 1 in an unloaded condition and another portion in a loaded condition.

FIG. 6 illustrates a cross-sectional view of a portion of a pocketed spring assembly 12 showing six strands of pocketed springs 26, three being compressed and three being expanded. As shown in FIG. 6, the strands 26 have a generally planar top surface 78 in a top plane P1 and a parallel generally planar bottom surface 80 in a bottom plane P2. The linear distance between the top and bottom surfaces 78, 80 of the strands 26 defines a height H of the strands 26. This linear distance further defines the height H of the pocketed spring assembly 12 because each of the strands 26 has the same height. However, it is within the scope of the present invention that different strands of springs of a pocketed spring assembly have different heights.

Figure 6A:
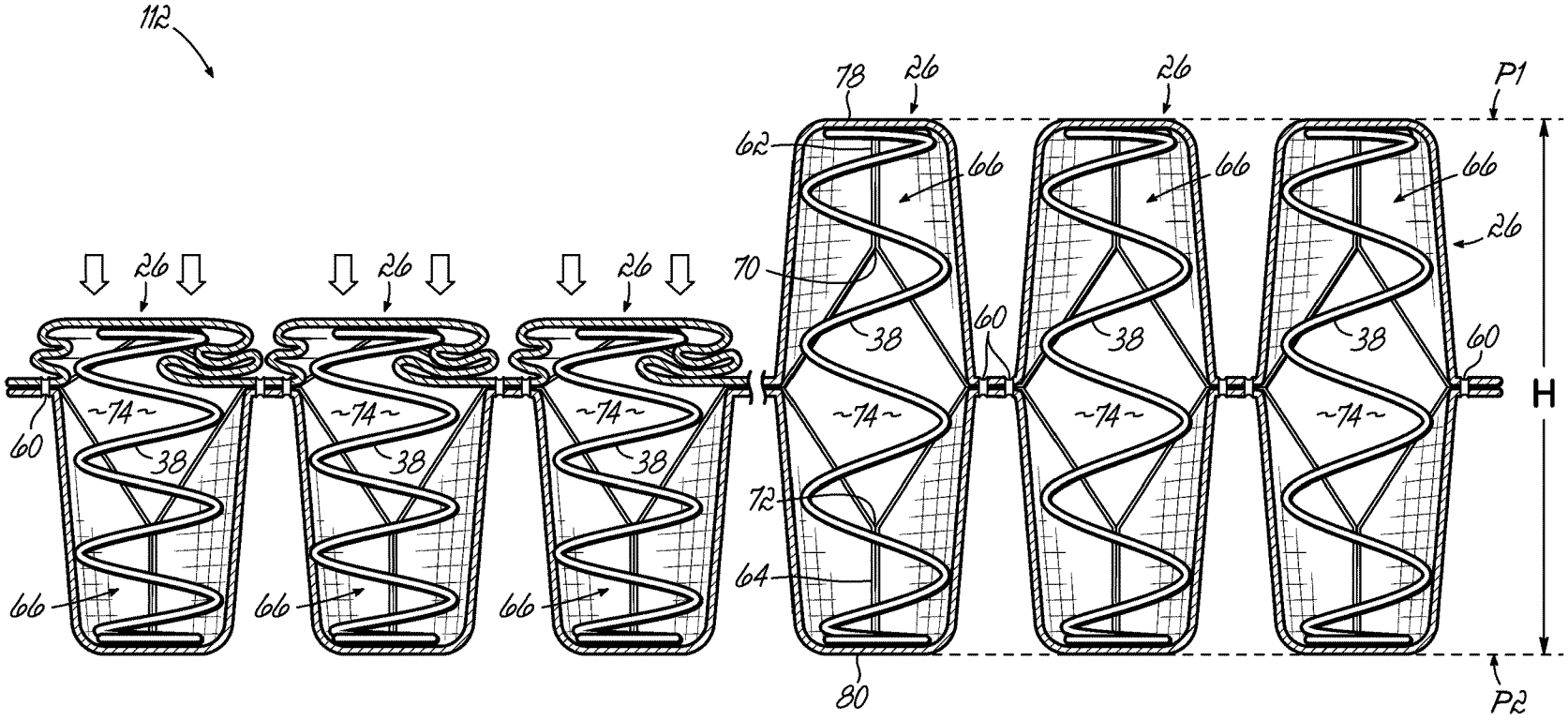
FIG. 6A is a cross-sectional view, like FIG. 6, of a portion of another embodiment of pocketed spring assembly, a portion of the pocketed spring assembly being in an unloaded condition and another portion being in a loaded condition.

FIG. 6A illustrates a cross-sectional view of a portion of a pocketed spring assembly 112 showing six strands 26, three being compressed and three being expanded. Like the other pocketed spring assemblies shown and described above, two longitudinal seams extend between adjacent strands of springs. However, along each of the sides of the pocketed spring assembly 112, only one, rather than two longitudinal seams 60 extends parallel the strands 26. This feature most likely results from the manufacturing process in which, at a desired location, the first and second sheets of fabric are cut between adjacent longitudinal seams 60 to create a pocketed spring assembly of the desired size.

Figure 6B:
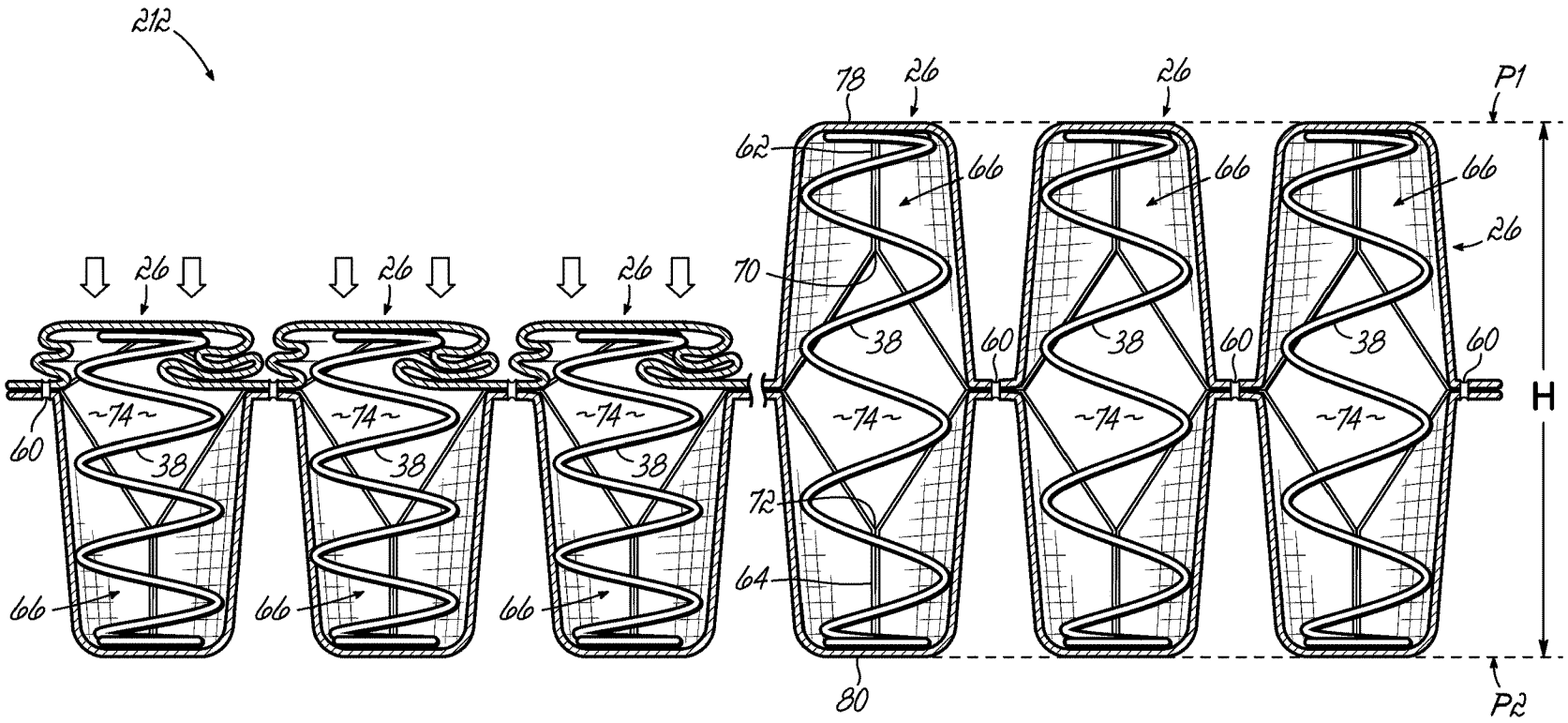
FIG. 6B is a cross-sectional view, like FIG. 6, of a portion of another embodiment of pocketed spring assembly, a portion of the pocketed spring assembly being in an unloaded condition and another portion being in a loaded condition.

FIG. 6B illustrates a cross-sectional view of a portion of another pocketed spring assembly 212 showing six strands 26, three being compressed and three being expanded. Unlike the other pocketed spring assemblies shown and described above, only one longitudinal seam extends between adjacent strands of springs and along each of the sides of the pocketed spring assembly 212. In pocketed spring assembly 212, the separating seams are the same as the other pocketed spring assemblies shown and described herein. However, the openings 76 are not present in the pocketed spring assembly 212 due to the single longitudinal seams between adjacent strands 26.

Figure 6C:
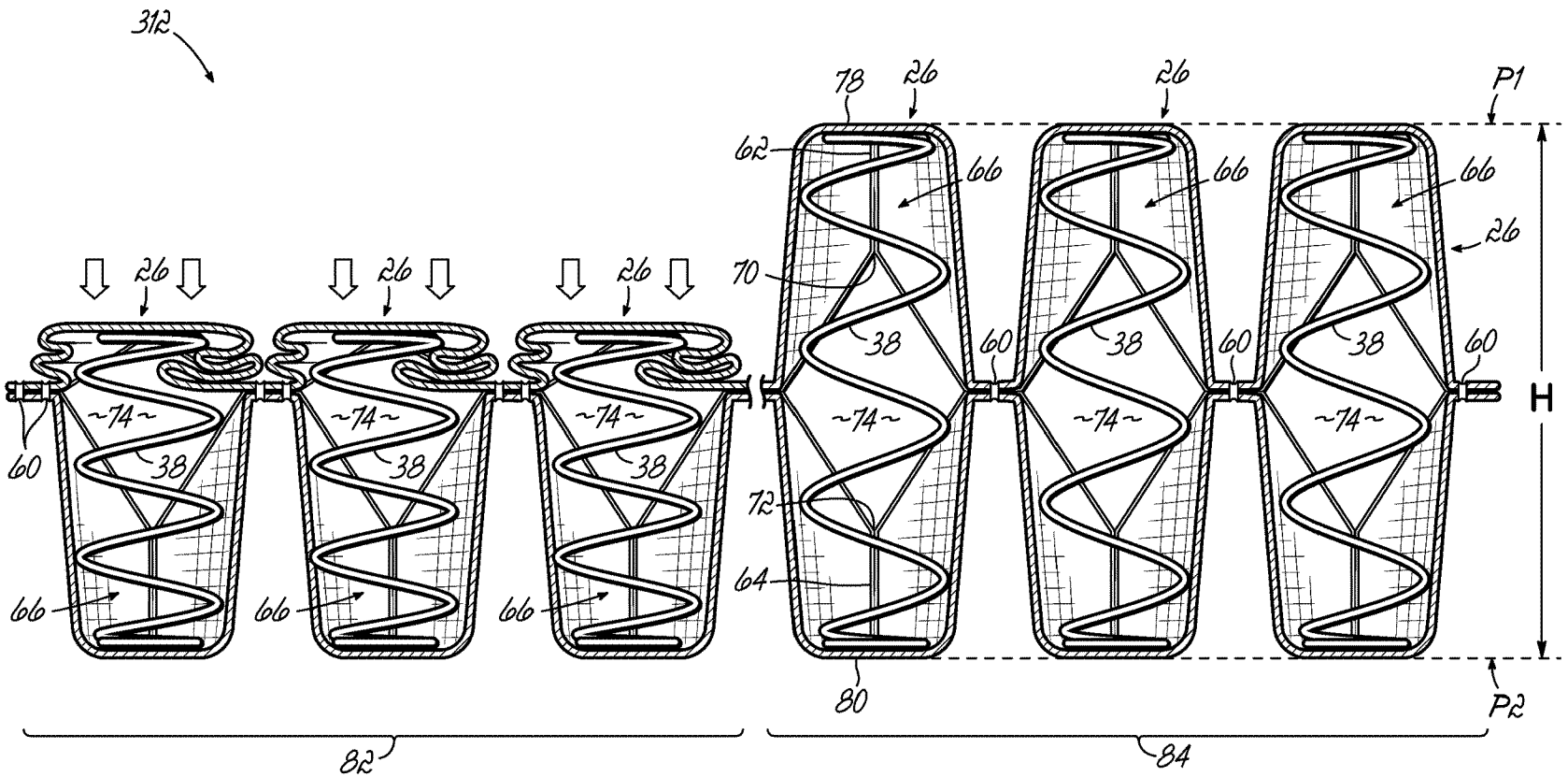
FIG. 6C is a cross-sectional view, like FIG. 6, of a portion of another embodiment of pocketed spring assembly, a portion of the pocketed spring assembly being in an unloaded condition and another portion being in a loaded condition.

FIG. 6C illustrates a cross-sectional view of a portion of a posturized pocketed spring assembly 312 showing six strands 26, three being compressed and three being expanded. In posturized pocketed spring assembly 312, half of the posturized pocketed spring assembly 312, region 84 is firmer than region 82 because region 84 has more strands 26 of pocketed springs. Region 84 may have more strands 26 than region 82 because adjacent strands 26 within firmer region 84 are separated by single longitudinal seams 60. On the other hand, adjacent strands 26 within softer region 82 are separated by double spaced longitudinal seams 60. By changing the number of longitudinal seams 60 and the distance between them, the spring density of one region may be greater than the spring density of another region. By changing the distance and number of longitudinal seams 60, any pocketed spring assembly shown or described herein may be posturized to have any number of regions of different firmness, regardless of the direction of the strands of pocketed springs.

The construction of the pocketed spring assemblies shown and described herein made from two sheets of fabric joined by any number of longitudinal seams between adjacent strands of springs provides greater independence to the strands than prior art pocketed spring assemblies in which glue beads join adjacent strings of springs. Therefore, loads on select strands affect adjacent strands less than prior art pocketed spring assemblies in which strings of springs are glued together. Such strand independence results in less motion transfer, an advantage of the unique pocketed spring assemblies shown and described herein.

FIGS. 3AA and 3BB illustrate cross-sectional views of a portion of another embodiment of pocketed spring assembly 412. For simplicity, like numbers represent like parts. As shown in FIG. 3AA, a first layer 134 comprising at least two sheets laminated together may be used in place of single first sheet 34. Similarly, a second layer 136 comprising at least two sheets laminated together may be used in place of second sheet 36. One or both layers 134, 136 may be made of multiple layers joined together, such as the fabric disclosed in U.S. patent application Ser. Nos. 15/062,595 and 15/584,402, for example. Although FIG. 3AA illustrates first and second layers 134, 136, each comprising three sheets joined together, any number of sheets may be joined together to create one of the layers 134 or 136. In some applications, one layer may comprise a single sheet of fabric, while the other layer may comprise multiple sheets joined together in any known manner, such as via lamination.

Any pocketed spring assembly shown or described herein may be incorporated into any bedding or seating product, regardless of whether the product is a single-sided or double-sided mattress or a seating cushion.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of those features. Accordingly, the scope of the invention shall be limited only by the following claims and their equivalents.

What is claimed is:

1. A bedding or seating product comprising:

a pocketed spring assembly comprising first and second sheets of fabric and rows of springs between the first and second sheets of fabric, the first and second sheets of fabric being joined by longitudinal seams to separate adjacent rows of springs into strands, longitudinal seams separating each row of springs from an adjacent row of springs, a plurality of pockets formed along each strand of springs by aligned first and second linear separating seams, each of the first linear separating seams joining said first sheet to itself and extending downwardly from an ear between adjacent pockets and terminating at a first end, each of the second linear separating seams joining the second sheet to itself and extending upwardly from an ear between adjacent pockets and terminating at a second end and at least one spring positioned in each said pocket, a distance between the first and second ends of aligned first and second separating seams defining a height of a gap having a diamond-shaped configuration allowing air to flow through pockets, the gap having a width between longitudinal seams on opposite sides of a strand;

cushioning materials; and a covering encasing said pocketed spring assembly and cushioning materials.

2. The product of claim 1 wherein said pocketed spring assembly has a plurality of diamond-shaped openings extending through the first and second sheets between adjacent longitudinal seams between adjacent strands.

3. The product of claim 1 wherein said rows of springs extend longitudinally.

4. The product of claim 1 wherein said rows of springs extend transversely.

5. The product of claim 1 wherein each of said springs has the same height.

6. The product of claim 5 wherein each of said separating seams has a length less than half the height of the pocketed springs.

7. The product of claim 5 wherein each of said separating seams has a length less than the height of the pocketed springs.

8. A bedding or seating product comprising:

a pocketed spring assembly comprising first and second sheets of fabric and rows of springs between the first and second sheets of fabric, the first and second sheets of fabric being joined by longitudinal seams to separate adjacent rows of springs into strands, longitudinal seams separating each row of springs from an adjacent row of springs, a plurality of pockets formed along each strand of springs by aligned first and second linear separating seams, each of the first linear separating seams joining said first sheet to itself and extending downwardly from an ear between adjacent pockets and terminating at a first end, each of the second linear separating seams joining the second sheet to itself and extending upwardly from an ear between adjacent pockets and terminating at a second end and at least one spring positioned in each said pocket distance between the first and second ends of aligned first and second separating seams defining a height of a gap having a diamond-shaped configuration allowing air to flow through pockets, the gap having a width between longitudinal seams on opposite sides of a strand.

9. A pocketed spring assembly for a bedding or seating product, said pocketed spring assembly comprising:

a first layer of fabric;

a second layer of fabric;

an array of springs comprising rows of springs between the first and second layers of fabric, the first and second layers of fabric being joined by at least one longitudinal seam separating adjacent strands of springs, a plurality of pockets formed along each strand of springs by first and second separating seams, each of the first separating seams joining the first layer of fabric to itself, each of the second separating seams joining the second layer of fabric to itself, at least one spring being positioned in each said pocket, wherein each of said first separating seams is spaced from a corresponding second separating seam with a diamond-shaped gap to partially separate adjacent pockets, thereby allowing air to flow though the diamond-shaped gaps between said adjacent pockets and wherein diamond-shaped openings extend through the first and second layers between adjacent longitudinal seams.

10. The pocketed spring assembly of claim 9 wherein the longitudinal seams are non-linear.

11. The pocketed spring assembly of claim 9 wherein said rows of springs extend longitudinally.

12. The pocketed spring assembly of claim 9 wherein said rows of springs extend transversely.

13. The pocketed spring assembly of claim 9 wherein each of said pocketed springs has the same height.

14. The pocketed spring assembly of claim 13 wherein each of said first and second separating seams has a length less than half the height of the pocketed springs.

15. The pocketed spring assembly of claim 13 wherein each of said first and second separating seams has a length less than the height of the pocketed springs.

16. A pocketed spring assembly for a bedding or seating product, said pocketed spring assembly comprising:

a first sheet of fabric;

a second sheet of fabric; and rows of springs between the first and second sheets of fabric, each of said rows of springs being separated from at least one adjacent row of springs by longitudinal seams joining the first and second sheets of fabric, a plurality of pockets formed along a strand of coil springs by first and second separating seams, each of the first separating seams joining the first sheet of fabric to itself, each of the second separating seams joining the second sheet of fabric to itself, at least one spring being positioned in each of the pockets, wherein each of the first separating seams is spaced from a corresponding second separating seam to partially open each of the pockets with a gap having a diamond-shaped configuration, thereby allowing air to flow between adjacent pockets, each of the gaps having a height between ends of aligned first and second separating seams and a width between adjacent longitudinal seams on opposite sides of a strand.

17. The pocketed spring assembly of claim 16 wherein diamond-shaped openings extend through the first and second sheets between adjacent longitudinal seams between adjacent strands.

18. The pocketed spring assembly of claim 16 wherein said rows of springs extend longitudinally.

19. The pocketed spring assembly of claim 16 wherein said rows of springs extend transversely.

20. The pocketed spring assembly of claim 16 wherein each of said pocketed coil springs has the same height.

21. The pocketed spring assembly of claim 20 wherein each of said first and second separating seams has a length less than half the height of the pocketed coil springs.

22. The pocketed spring assembly of claim 20 wherein each of said first and second separating seams has a length less than the height of the pocketed coil springs.

23. A pocketed spring assembly for a bedding or seating product, said pocketed spring assembly comprising:

a first layer of fabric;

a second layer of fabric;

an array of springs comprising rows of springs between the first and second layers of fabric, the first and second layers of fabric being joined by at least one longitudinal seam separating adjacent strands of springs, a plurality of pockets formed along each strand of springs by first and second separating seams, each of the first separating seams joining the first layer of fabric to itself, each of the second separating seams joining the second layer of fabric to itself, at least one spring being positioned in each said pocket, wherein each of said first separating seams is spaced from a corresponding second separating seam with a diamond-shaped gap to allow air to flow though the diamond-shaped gaps between said adjacent pockets and wherein openings extend through the first and second layers between non-linear longitudinal seams extending between adjacent strands.

* * * * *